United States Patent [19]

Girard et al.

[11] 4,331,713

[45] May 25, 1982

[54] PROCESS AND APPARATUS FOR THE CONTINUOUS COATING OF A SHEET ARTICLE, PARTICULARLY A WEB OF PAPER OR PAPERBOARD

[75] Inventors: Pierre Girard, Saint-Ismier; Michel Richard, Le Touvet, both of France

[73] Assignee: Centre Technique de l'Industrie des Papiers, Cartons et Celluloses, Grenoble, France

[21] Appl. No.: 129,656

[22] Filed: Mar. 12, 1980

[30] Foreign Application Priority Data

Mar. 14, 1979 [FR] France ..... 79 06506
Feb. 15, 1980 [FR] France ..... 80 03392

[51] Int. Cl.[3] ..... B05D 1/42

[52] U.S. Cl. ..... 427/209; 118/121; 118/122; 118/123; 118/126; 427/424; 427/356

[58] Field of Search ..... 118/121, 122, 123, 126; 427/424, 209, 356

[56] References Cited

U.S. PATENT DOCUMENTS

| | | | |
|---|---|---|---|
| 2,027,461 | 1/1936 | Anderson | 118/122 |
| 2,372,248 | 3/1945 | Bouton | 118/122 X |
| 3,158,498 | 11/1964 | Carpenter | 427/356 |
| 3,181,500 | 5/1965 | Paulson et al. | 118/126 |
| 3,192,895 | 7/1965 | Galer . | |
| 3,442,684 | 5/1969 | Woodham et al. | 118/126 X |
| 3,518,964 | 7/1970 | Nagler | 118/126 X |
| 3,882,817 | 5/1975 | Zink | 118/122 X |
| 3,930,464 | 1/1976 | Wallsten | 118/122 |
| 4,063,531 | 12/1977 | Zitzow | 118/122 |
| 4,076,865 | 2/1978 | Wallsten | 118/122 |
| 4,133,917 | 1/1979 | Wallsten | 118/126 X |

FOREIGN PATENT DOCUMENTS

| | | |
|---|---|---|
| 1301630 | 7/1962 | France . |
| 1331840 | 5/1963 | France . |
| 1410373 | 8/1965 | France . |
| 2001560 | 2/1969 | France . |
| 2136100 | 11/1972 | France . |
| 2359650 | 7/1976 | France . |
| 2321951 | 8/1976 | France . |
| 2321952 | 8/1976 | France . |

*Primary Examiner*—Shrive P. Beck
*Attorney, Agent, or Firm*—Sandler & Greenblum

[57] ABSTRACT

This invention relates to a method and apparatus for continuously coating of a sheet article.

The sheet article 21 is continuously driven and passes, upwardly along a vertical portion of its travel path, between two flexible blades 38 mounted on an holder 34 in such a manner that their feet are spaced from the sheet article 21.

A coating composition 42 is injected into the corner 41 formed between the element 21 and the blade.

The planer shape of the end zone of the blade applied against the sheet article in a parallel direction may be carried out by a pneumatic tube 40, as shown, or by other means such as flexible counterblades.

The invention may be used, among others, in the coating of paper or paperboard.

6 Claims, 13 Drawing Figures

PROCESS AND APPARATUS FOR THE CONTINUOUS COATING OF A SHEET ARTICLE, PARTICULARLY A WEB OF PAPER OR PAPERBOARD

The present invention firstly relates to a novel continuous surface coating process with a coating composition of a sheet article such as a web of paper, paperboard or synthetic materials. It relates likewise to a device for carrying out the process.

The surface coating of a sheet article is usually done so as to improve the qualities of the article, particularly in the case of paper or paperboard. The coating is carried out in a known way by the deposition of a coating composition on the sheet article which is driven along a path followed by a spreading and a smoothing action of the composition so as to obtain a layer thickness which is as constant as possible. The spreading and smoothing operation is particularly critical and has been the subject of elaborate technical studies with the aim of finding ways to eliminate any malformations with respect to the appearance of the coating obtained.

The present invention relates to a novel improvement over previous coating methods. In effect, applicant has discovered that the known coating techniques involve some unfavorable consequences with respect to the sheet article as well as with respect to the layer of material with which the sheet article is coated.

Known techniques proceed by applying the coating composition at a relatively substantial distance from the zone at which the spreading and smoothing are done.

As a result, the coating composition remains in contact with the sheet article during a relatively substantial amount of time before the spreading is performed. It has, therefore, been observed that the time of contact of the composition with the sheet article varies from 0.01 seconds to 1 second depending upon whether one uses a fast or slow coating device. As a result, when one uses a coating composition comprising a liquid phase, there is a capillary migration of the liquid into the sheet article. The magnitude of the capillary migration during the time of contact between the composition and the sheet article prior to the coating, is practically identical to that which is involved by the spreading operation, properly so called, which is caused by the application of a pressure on the coating composition. This migration of a portion of the liquid phase of the coating composition causes:

(a) possible modification (which varies as a function of the texture of the sheet article) of the mechanical and/or chemical structure of the sheet article with risk of damage of the sheet article (breaking lack of flatness, etc.); and (b) corresponding modification of the coating composition whose viscosity in the area where the spreading occurs will be greater than the initial viscosity of the composition, which may result in defects in the regularity of the layer and difficulties of monitoring the spreading and smoothing operation.

The above disadvantages result whatever the used coating techniques, e.g., coating by rollers or by blade applicators.

The process according to the present invention has for an object to eliminate the disadvantages referred to hereabove by reducing to the maximum extent possible the time of contact of the coating composition with the sheet article prior to the spreading and smoothing operation.

It will be immediately noted that the process according to the invention can be used with any type of coating composition and over a wide range of industrial applications.

Thus, it is particularly appropriate for the coating of paper in aqueous or solvent medium for:

(a) applying of color coatings, so as to improve the appearance and the printability; and (b) sizing with the aim of reinforcing the mechanical or other properties which are particular to a given support (dielectric properties, conductive properties, anti-stick properties, etc.). The compositions utilized may contain, for example, starch, cellulosic derivatives, polyvinyl alcohol, plastic dispersions, e.g., polyvinyl acetate, styrene-butadiene latex or acrylic copolymers; dielectric resins, conductive polymers, silicones and various laquers and varnishes.

The process can equally be used for the coating of paper in a melted medium, i.e., for the application of thermofuseable polymers, paraffins, waxes, or hot-melt. It also makes it possible to proceed the coating with powdered products which are further fixed onto the base web such as by heating through an oven, for example, if a thermofuseable powder is used. One can also proceed the coating by using products in the foamed state.

Furthermore, the process of the invention makes it possible to apply the coating composition either on one or on both sides of the sheet article.

The process according to the invention is preferably performed by means of known coating apparatus, particularly such as that which is described in French Pat. No. 2,359,650, in which the sheet article is driven between two elements, at least one of which is constituted by a smoothing blade subjected to a biasing force towards the second element which may be composed of a fixed reaction element or by a backing roll around which the sheet article is driven, or further by a second blade set opposite to the first blade.

It is, in effect, with this type of device that the process according to the invention provides optimum results. It will be noted that with this type of coating apparatus, the blade is spaced from the sheet article beginning at its contact zone with the sheet article. With this device, the process according to the invention comprises, in its general aspect, injecting the coating composition directly into the corner formed between the blade and the sheet article and as closely as possible to the zone of contact between the blade and the sheet article.

It will be noted that injection of the composition immediately adjacent to the coating zone has the additional advantage of resulting in, in the bulk of the coating composition, a shearing state which preserves its fluidity until its passage under the blade, thereby assuring a more efficient and homogeneous smoothing and, therefore, a substantially improved coating quality.

Furthermore, an important aspect of the invention lies, in the fact that the sheet article is driven along a path having at least a portion of its trajectory substantially vertical from bottom to top and the coating composition is injected likewise along a direction oriented from bottom to top. This particular arrangement makes it possible to assure a good regularity of the deposit of the coating composition all over the width of the sheet article by carrying out an efficient evacuation of any possible excess of the coating composition without risking the formation of a buildup as would be the case if one were to proceed by injecting from top to bottom with movement of the sheet article in the same direction.

According to another aspect of the invention, the composition is applied, in a manner known itself, by an injector. The outlet orifice of the injector is set, according to the invention, at the level of or immediately adjacent to the contact or smoothing zone between the sheet article and the smoothing blade.

In the case where the coating composition cannot be applied exactly at the level of the smoothing zone, one aims at placing the outlet of the injector, normally set upstream of this zone with respect to the direction of movement of the sheet article, at a distance from the exterior edge of the blade which is as short as possible as a function of the mechanical necessities imposed by the travel of the sheet article and by the structure of the injector and oriented towards the apex of the angle formed by the blade and the sheet.

The invention also relates to a coating apparatus of a sheet article which comprises, in a known manner, a guidance and travel continuous system for the sheet article means for applying a coating composition over at least one of the sides of the sheet article and two elements between which the sheet article runs. At least one of these elements exerts a pressure on the sheet article so as to result in the spreading and smoothing of the coating composition; the said element being a blade whose first end is applied against the sheet article and whose second end is spaced therefrom. The device is characterized in that the means for applying the coating composition is an injector whose outlet orifice is directed towards the apex of the angle formed between the sheet article and the blade. Various apparatus structures according to the invention can be provided and will be discussed in further detail in the following description.

It will be noted simply, that the blade will preferably consist of a flexible and thin blade which is elastically deformable and whose free end, in contact with the sheet article, will be associated with a pressure element assuring the evenness of the end of the blade in contact with the sheet article and its parallelism with the sheet article.

The pressure element may consist of a tube containing a fluid under pressure. According to one advantageous embodiment of the invention, the pressure element comprises an elastic counterblade, which may be less supple than the smoothing blade, set outward of the smoothing blade, with respect to the sheet article, and whose free end is supported against the smoothing blade at the point of contact between the smoothing blade and the sheet article.

Several embodiments of the invention will now be described, by way of non-limiting examples, with reference to the attached drawings in which.

Figure 4:
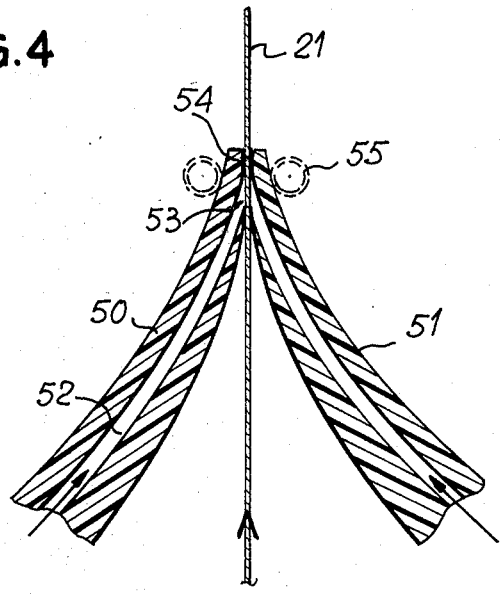
Figure 5:
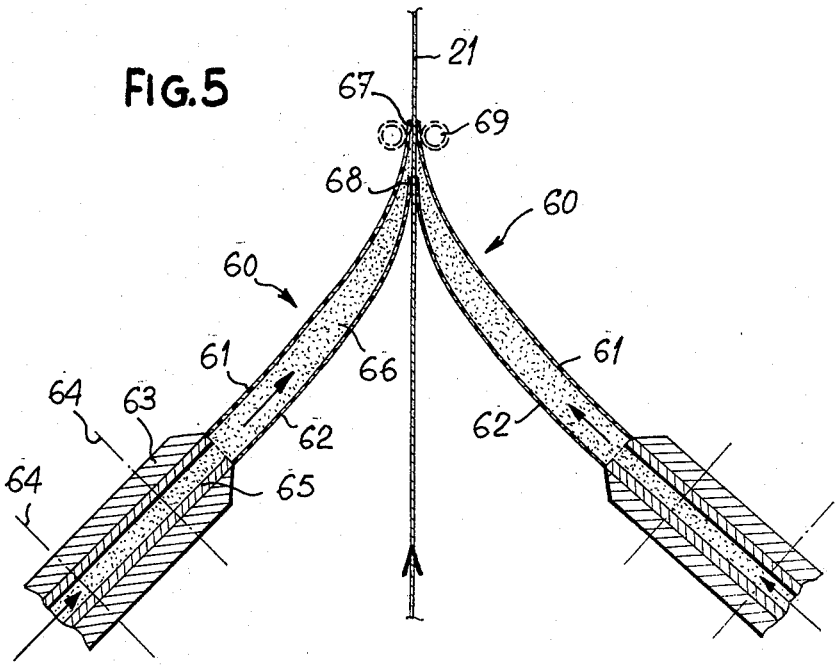
Figure 6:
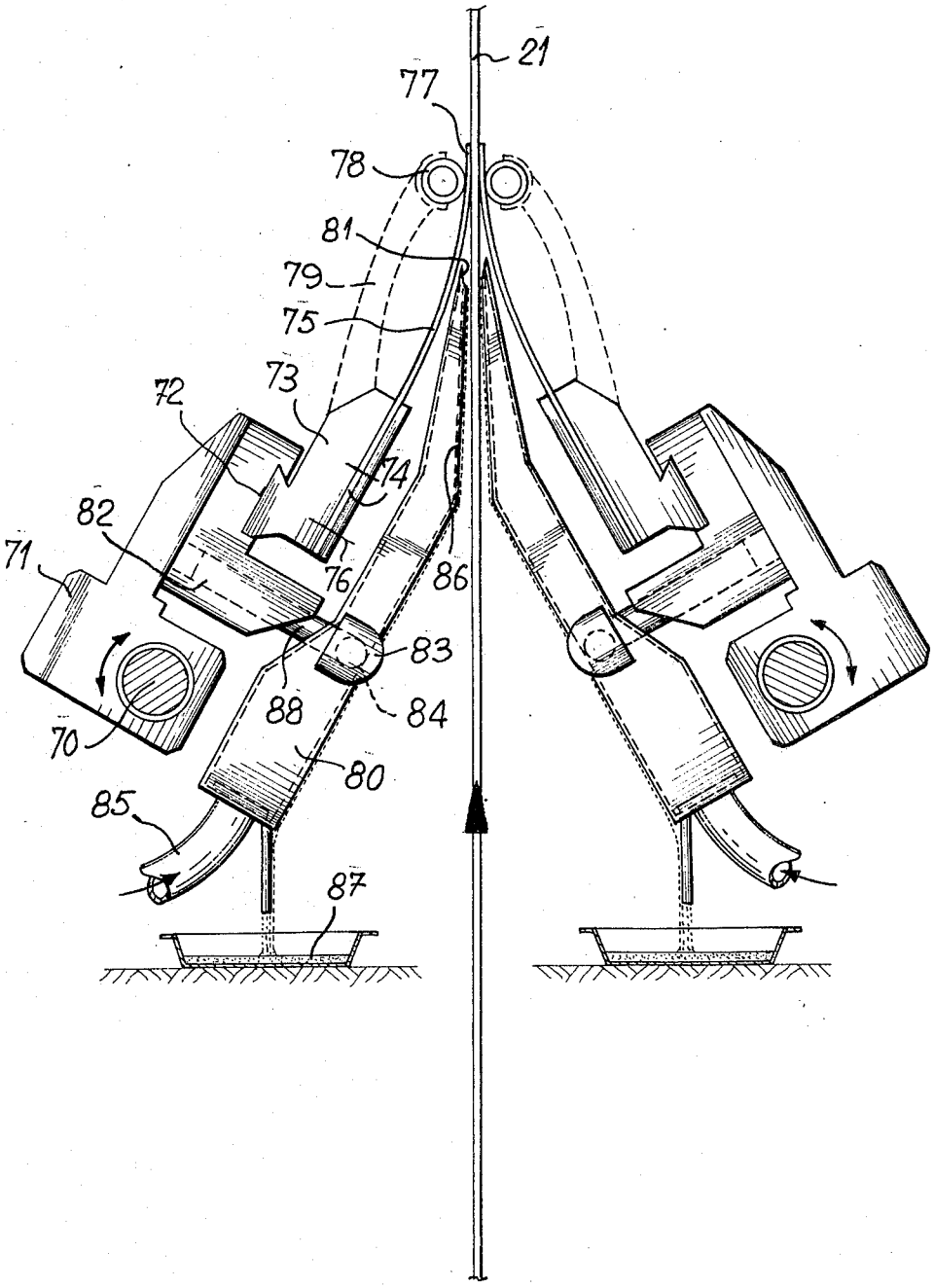
Figure 7:
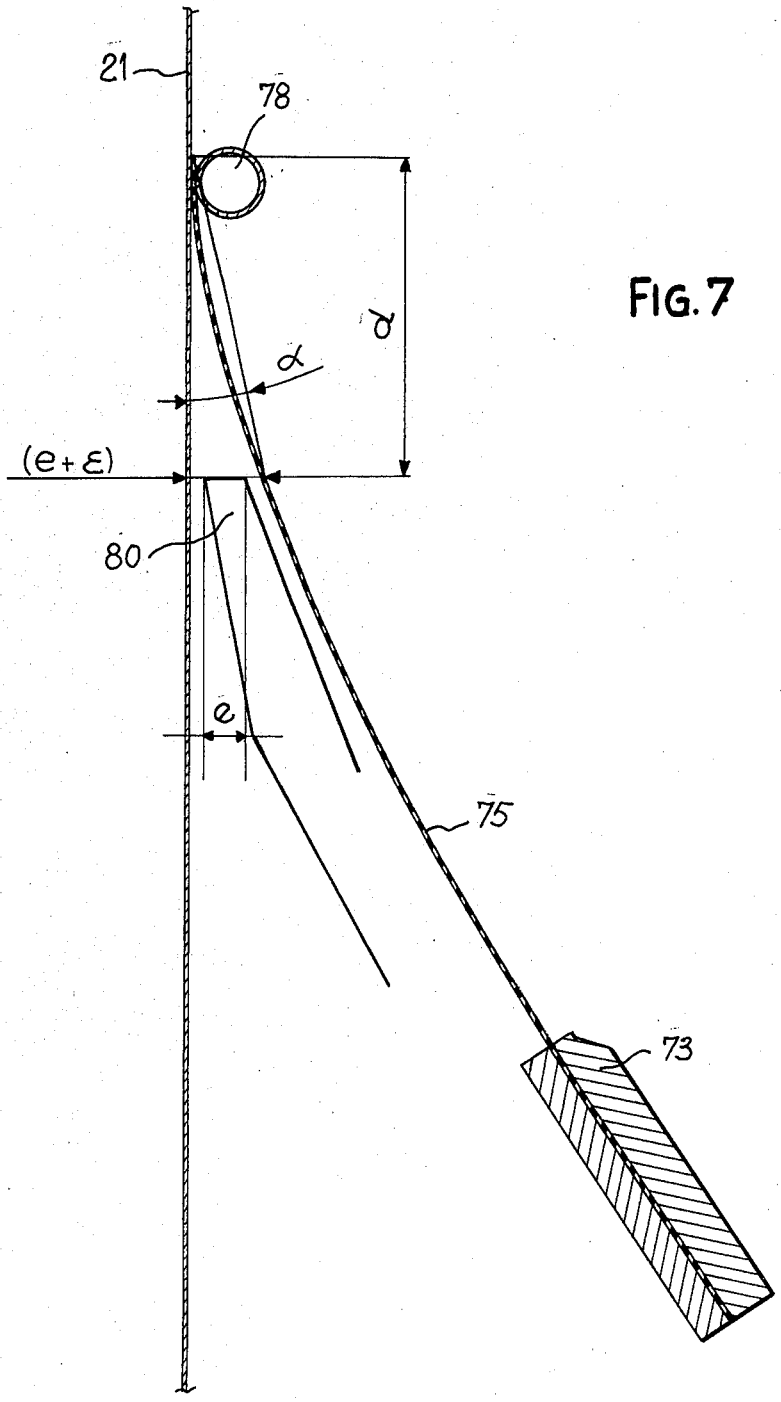
Figure 9:
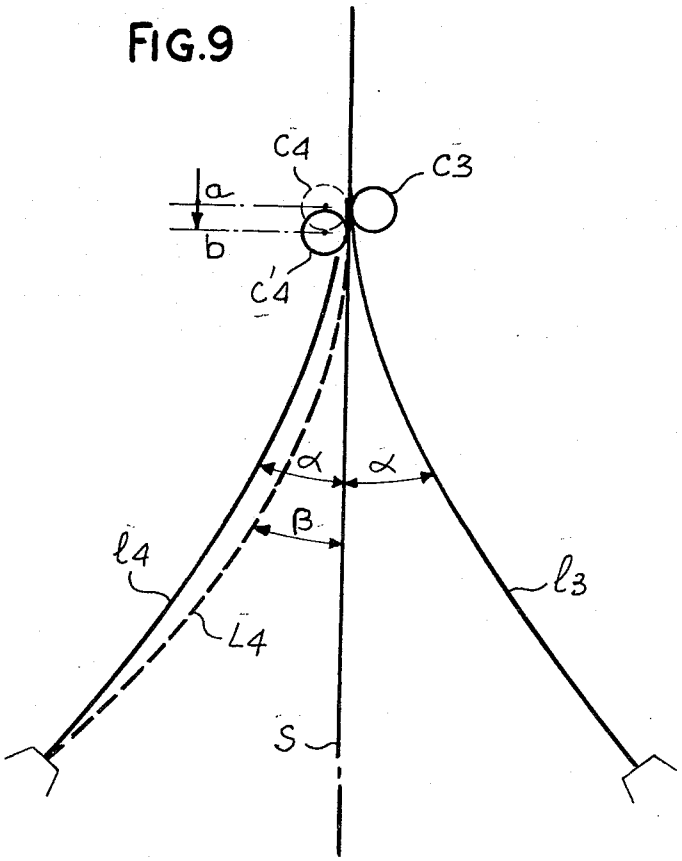
Figure 8:
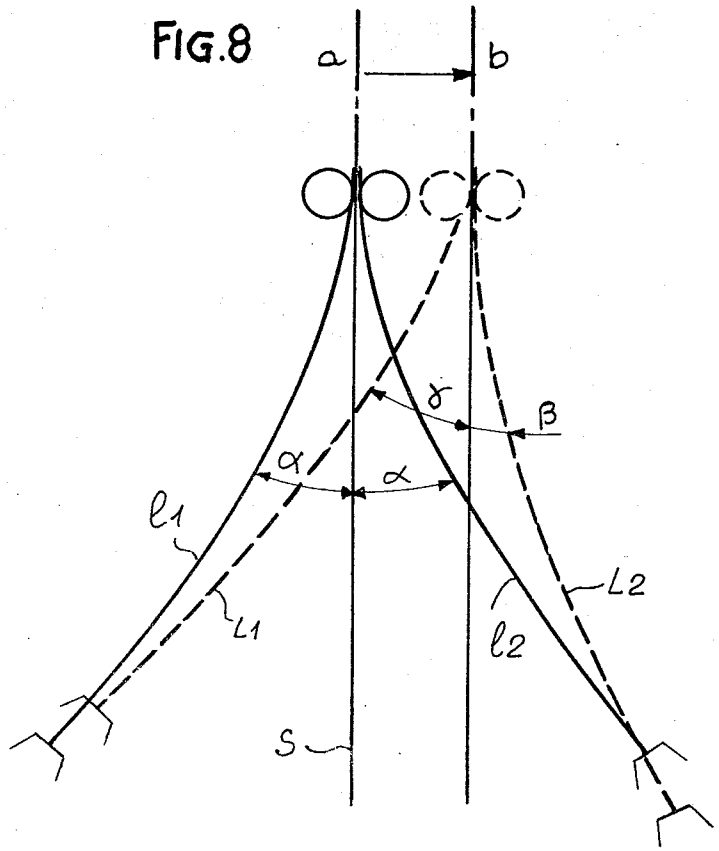
Figure 11:
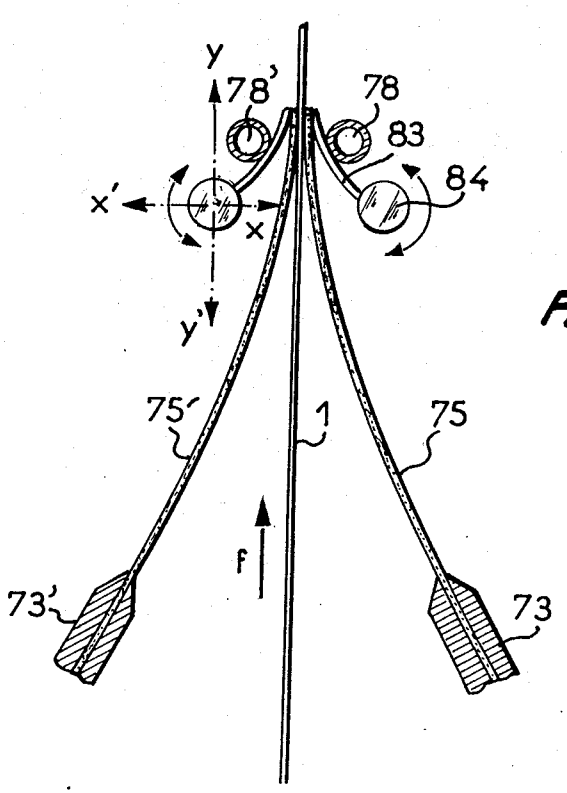
Figure 10:
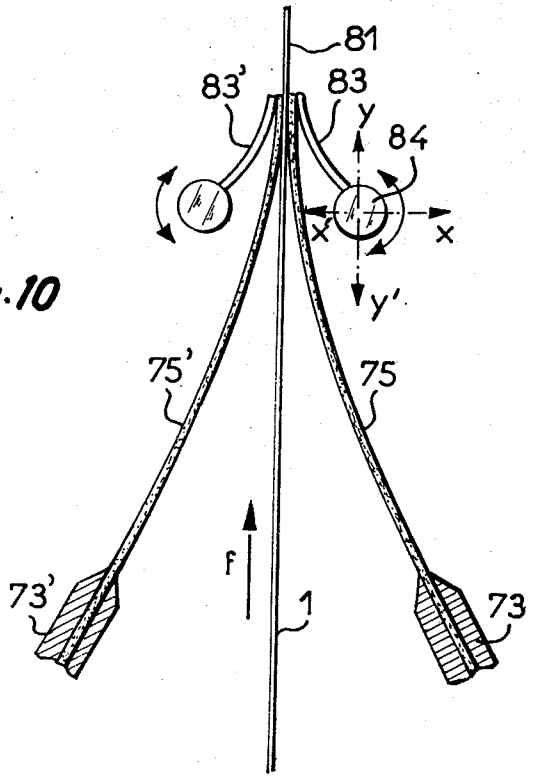
Figure 13:
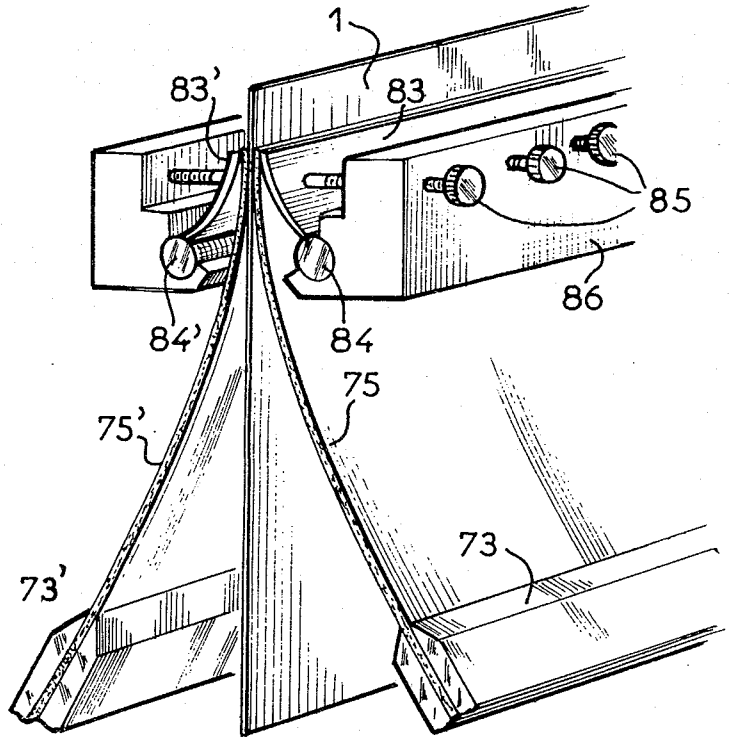
Figure 12:
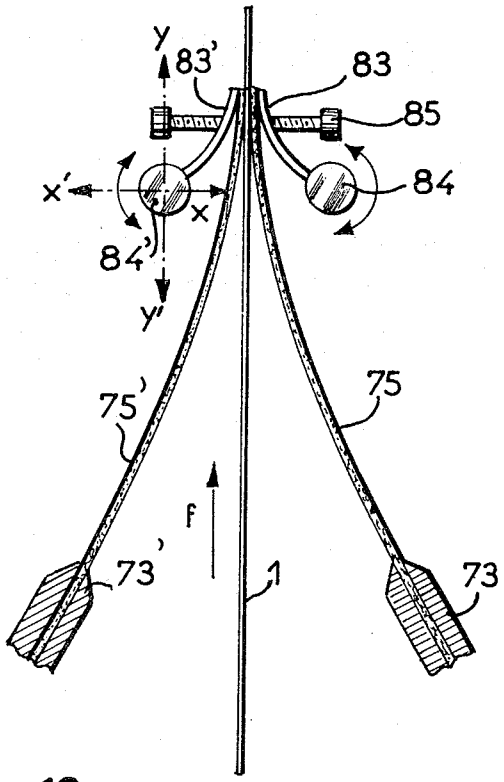

FIGS. 4 and 5 schematically illustrate in cross section two alternative embodiments of a coating device;

FIG. 6 is a plan view of an advantageous embodiment of a coating device for carrying out the invention;

FIG. 7 is an explanatory schematic illustration;

FIGS. 8 and 9 schematically illustrate in plan view the setting of the device permitting a dissymmetry of the coating of the two sides of the sheet article;

FIG. 10 schematically illustrates a cross-sectional view, perpendicular to the edge of the blades of a both sides coating device according to the invention;

FIGS. 11 and 12 are cross sectional views similar to FIG. 10 for an alternative embodiment; and FIG. 13 is a perspective view of the device of FIG. 12.

To make clear the description of the embodiments disclosed below it will be considered that one desires to coat a web of paper, and, as a result, the terms "paper web", "coating composition", and, in a general manner, "coating system" will be the terms used.

Nevertheless, it is obvious that these terms should not be construed narrowly as a limitation of the invention and that, in the case where articles other than paper, paperboard, or non-woven sheets, and among others a film of plastic material or of a strip of fabric would to be treated one of ordinary skill in the art would adapt the teachings of the invention by means readily available to him.

Figure 1:
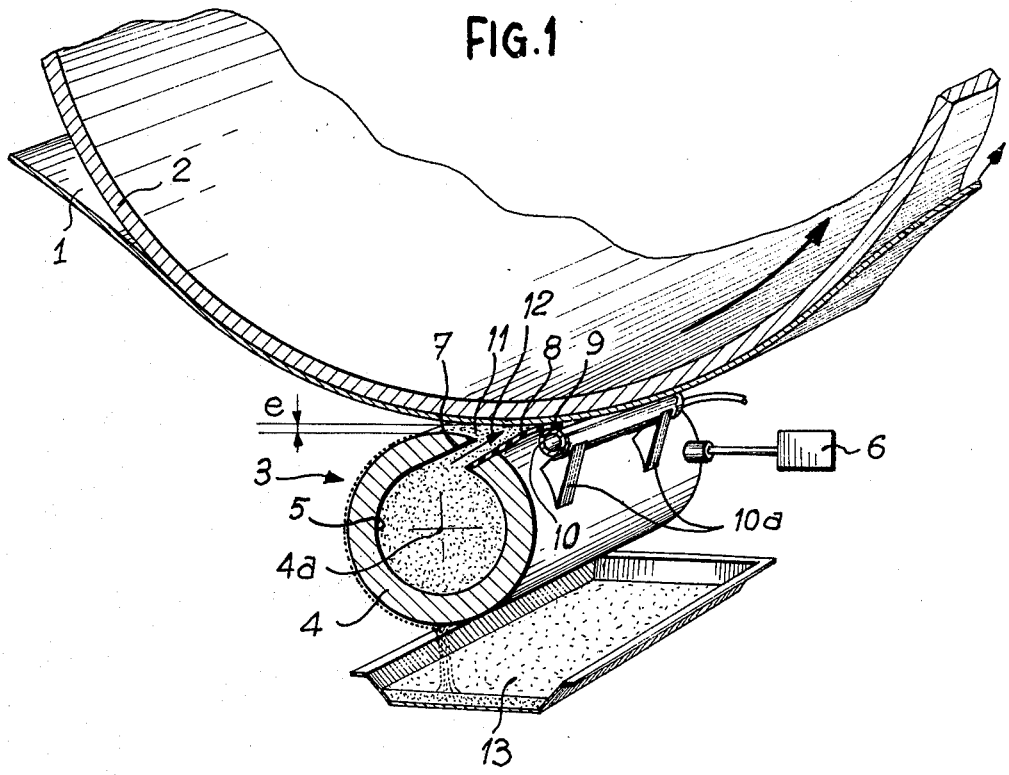
FIG. 1 is a schematic perspective view of a first embodiment of a device according to the invention, consisting of a roller cooperating with a smoothing blade.

FIG. 1 illustrates in perspective and cross-section a coating device of a web 1 intended to coat a single side of the web. The web 1 is set in motion in the direction of the arrow by a conventional running device not shown. The sheet partially rolls around a rotating roller 2. The coating device is indicated in a general manner by reference 3 and comprises a container or box 4 which is fixed and hollow, set under the roller 2 and spaced therefrom by a distance "e". The axis 4*a* of the container extends substantially parallel to the axis of the roller and along the full length of the roller. The internal chamber 5 of the container, closed at its ends is fed with a coating composition under pressure by a pumping system shown schematically as 6 and connected to a reservoir containing the composition. A slit 7 is provided along the length of the container adjacent to the roller 2. The immobile end of a flexible blade 8 is mounted on one of the edges of the slit. The free end of this flexible blade is biased elastically to rest against the web 1, downstream of its fixed end in the travel direction of the web, thanks to the flexion of the said blade whose convexity is directed towards the roller 2. The setting is such that the free end 9 of the blade is tangent to the curvature of the roller. In order to assure the evenness of the portion 9 of the blade in contact with the sheet article, a pneumatic tube 10 mounted on the container 4 by means of a support 10*a* (maintaining the tube along its entire length) exerts a pressure all over the length of the end 9 of the blade. The tube is connected to a source of air under pressure, for example, which makes it possible to regulate the pressure being exerted on the blade.

As seen in FIG. 1, the fixed end of the blade is spaced from the sheet article and the blade forms an angle or corner 11 with the sheet article. Furthermore, the edges of the slit 7 provided in the container are inclined from inner towards outer, in the direction of the run of the sheet article such that they provide a guide, in the direction of the arrow 12, of the composition leaving the chamber 5 under pressure in the direction of the angle 11 formed between the blade and the sheet article. It may be observed that the arrow 12 is substantially oriented along the bisector of the angle formed between the blade and the sheet article. It will be noted that any possible excess of the coating composition can be evacuated from the angle 11 by running off in the direction of the arrow 3 on the portion of the container situated upstream of the slit 7, the fraction of the composition thus eliminated being recovered, for example, in a reservoir 13 situated under the container. The distance "e" between the apex of the container and the web will be sufficient to allow the excess portion of the coating composition to run off while avoiding contact between this excess and the web.

Naturally, it will be understood that the shape of the container as well as the composition feed system may vary without departing from the scope of the invention. Likewise, one could provide another setting of the container with respect to the roller, so long as the container is positioned in the area of the lower half-circumference of the roller. Finally, instead of a continuous slit 7, one can provide a series of outlets in the container which are separated from one another.

The embodiments which will be described below assure the simultaneous coating of the two sides of the sheet article.

Figure 2:
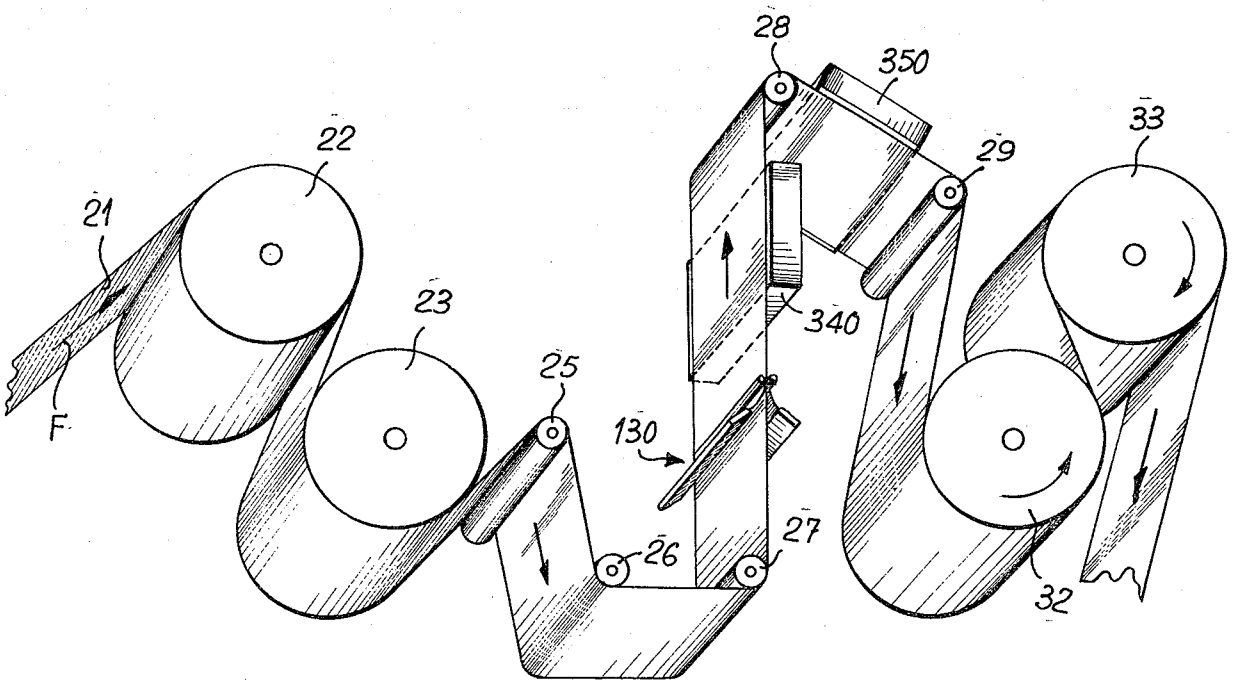
FIG. 2 is a schematic perspective view of a coating system installation utilizing a structure according to FIGS. 3–7.

FIG. 2 illustrates the general configuration of a coating apparatus according to the invention.

It is known that a coating apparatus can be utilized:

(a) either for coating a sheet article previously formed and, in this case, it can itself be an independent apparatus; however, in this case, winding and intermediate storage of the web will be necessary; or (b) directly for coating a sheet article through a defined section of the machine which forms the sheet article itself.

It is this second case, which will be described by way of example in the following description. Thus, FIG. 2 illustrates the end section of a paper making machine equipped with a device according to the invention.

Between two groups of drying cylinders 22, 23 and 32, 33 of the drying part of a conventional paper machine, whose head nor end is shown, the web 21 passes over a series of rollers 25, 26, 27, 28 and 29, which assure both its tension and its running along a predetermined path.

The web of paper travels vertically between the rollers 27 and 28 and it is at this level that it runs through a coating device according to the invention, indicated generally by 130, and which will be described in further detail below.

In the particular case shown in FIG. 2, the two sides of the web are coated and, consequently, must ultimately be subjected to a pre-drying operation of the coating before the web enters into contact with the cylinders 32 and 33 so as to avoid that the coating which is still fresh, does not adhere to the cylinders and is consequently, damaged.

A first pre-drying element 340 for the side of the web intended to enter into contact with the roller 28 is shown and a second pre-drying element 350 for the other side of the web is also shown.

Naturally, it will be understood, that as in the case of FIG. 1, the device according to the invention could likewise be used for the coating of only a single side of the web and, in this case, only one drying system could be provided.

The sheet article 21 travels in the case of FIG. 2, vertically from bottom to top.

The coating device 130 may comprise any one of the various embodiments which will now be described.

Figure 3:
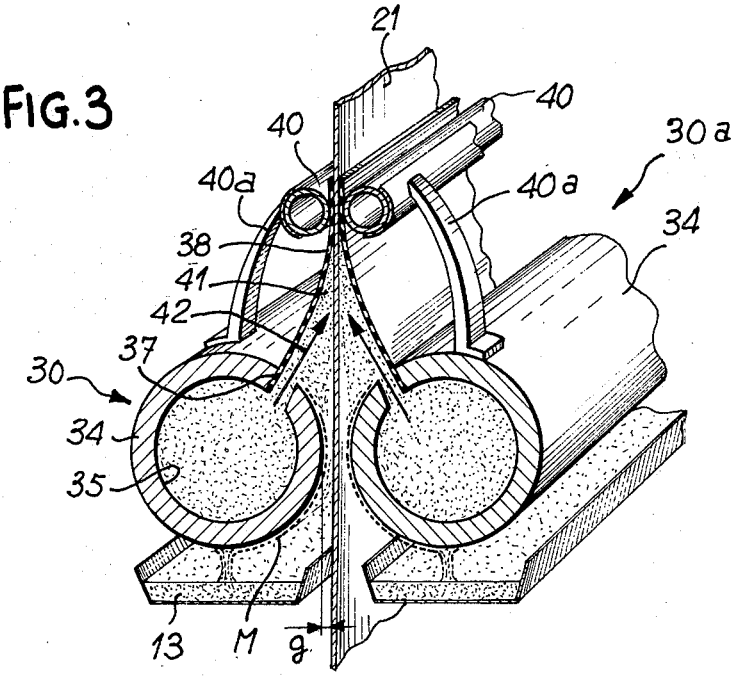
FIG. 3 is a perspective view of a second embodiment of a two blades coating device.

In FIG. 3, a coating device comprises two container assemblies 30 and 30*a* similar to the container of FIG. 1 and set on both sides of a web of paper 21 moving substantially vertically from bottom to top. In the example shown, the two container assemblies 30 and 30*a* are identical and symmetrical with respect to the plane of the web 21. It will, therefore, be sufficient to describe only one container assembly. As in the case of FIG. 1, the container 34 comprises an internal chamber 35 in which the coating composition, fed under pressure, circulates. An inclined slit 37 (acting as an injector) is provided in the container and against the wall of the slit furthest from the web 21 is fixed a flexible blade 38 which is elastically deformable. An holder 40*a* mounted on the container 34 supports a tube 40 along its full length. The tube 40 is filled with a fluid under pressure, the pressure being adjustable.

In the position of operations shown in FIG. 3, the two blades 38 are applied on both sides of the web 21, their free ends being exactly opposed and forming a zone of contact with the web which is parallel thereto so as to perform the spreading and smoothing of the layer of coating. The blades are maintained under pressure against one another and they thus have a curvature whose convexity is directed towards the web 21, the blades being spaced from the web beginning with their free end and forming an angle 41 with the web. The axis of the slit, illustrated by the arrow 42 (which also shows the path of the stream of coating composition injected in the angle 41), is oriented substantially towards the smoothing zone provided by the free ends of the blades. The stream of the composition thus reaches the web immediately upstream of the smoothing zone. Any possible excess of material M projected runs off along the internal faces of the containers 34 without coming into contact with the web thanks to the spacing "g" between the web and the internal faces of the containers. This excess M is recovered in the reservoir 13 and may be recycled to the internal chamber of the container through the feed system, not shown, of the container.

In FIG. 4, another embodiment has been schematically illustrated in which two rigid and symmetrical blades 50 and 51 are used, of which only blade 50 will now be described. This rigid blade has a general curvature directed towards the web 21 and is bored up with a median canal 52 for the delivery of the coating composition unto the web. The canal 52 communicates on the one hand with a source of the composition under pressure, not shown, and opens, on the other hand, at 53 at the free end of the blade, this free end having a zone 54 which is plane and parallel to the web 21, which zone serves to carry out the spreading and smoothing of the coating. The blades may be articulated at their lower ends mounted on a fixed holder (not shown) so as to allow the adjustment of the thickness of the coating layer to be deposited.

For their application against the web 21, one can provide any type of system of tensioning the blades and, for example, pneumatic tubes such as those which are shown in dashed lines at 55 (these tubes being of the same type as those of FIGS. 1 and 3) may be used.

The example shown in FIG. 4 is the ideal setting where injection of the coating composition and the smoothing occur simultaneously and at the same location.

However, this situation may be difficult to achieve on an industrial scale.

In the embodiment shown in FIG. 5, the coating and smoothing device is made up of two pairs of blades 60 arranged symmetrically with respect to the vertical web 21 and only one pair of blades will now be described. The two blades 61 and 62 of each pair are flexible and elastically deformable. They are, furthermore, attached at their lower end to a blade holder 63 by screws 64 allowing them to be removed. As may be seen in FIG. 5, the holders 63 are spaced on both sides of the web 21. Furthermore, in the holder, the two blades are spaced from one another by a hollow casing 65 which allows for the admission under pressure of the coating composition in the direction of the arrow. The casing is connected to a source of the coating composition (not shown). Thanks to this setting, the two blades 61 and 62 are superposed and substantially parallel. In the position of operation shown in FIG. 5, the two blades 61 are applied against one another, under pressure, on each side of the web 21 and it is the same for the two blades 62. The pressure of the blades results from the positioning of the holders 63. An inject passage 66 is provided between the blades 61 and 62 allowing the injection of the coating composition between the free ends 67 and 68 of the blades on the web 21. It will be noted that at least the free ends 67 of the downstream blades 61 (in the direction of movement of the web 21) are applied against the web so as to be plane and parallel to the web. The evenness of these ends may be maintained by a pneumatic tube 69 (shown in dashed lines) identical to the tubes of FIGS. 1–4.

The embodiment shown in FIG. 6 appears to be particularly convenient for industrial application. A fixed structure (not shown) is equipped with two bars 70 which are substantially horizontal and spaced and between which the web 21, intended to receive the coating composition, vertically runs. The coating device consists, as was previously the case, of two assemblies symmetrical with respect to the web of which only one will now be described.

On the bar 70 a support structure 71 is mounted suited to rotate and to be immobilized around the bar by means of a position adjustment mechanism (not shown). The support structure 71 has a guide groove 72 in which a blade holder 73 is engaged which can be blocked in the guide groove by an appropriate means. The lower end 74 of a blade 75 is removeably fixed in the holder, for example, by screws 76 so as to allow for possible replacement of the blade.

The blade 75 is flexible and elastically deformable and when the two structures 71 are in the position shown in FIG. 6, the free ends 77 of the blades are applied on the web 21. The blades are maintained in this position under pressure and they have, as a result, a curvature whose convexity is turned towards the web 21.

It will be noted that the blade holders 73 are spaced from the web 21 by a distance which may be adjusted by means of the structure 71. This allows the modification of the force applying the blade against the web and, as a result, the thickness of the layer of coating.

Preferably, the free end 77 of each blade is associated with a pneumatic tube 78 containing a fluid under pressure (whose pressure may be adjusted) and exerting on the end of the blade a pressure whose direction is substantially perpendicular to the web. This pressure ensures the evenness of the end of the blade and its parallelism with the web. Each pneumatic tube can be supported along its full length, for example, by a support whose arms 79 (shown in dashed lines) are fixed to the corresponding blade holder. An injector 80 of coating composition constituted by a hollow elongated casing and open at 81 so as to form an injection spout is held by the structure 71, between the web 21 and each of the blades 75.

The suspension of the casing comprising rods 88 whose one end 82 is engaged in an adjustable manner in the structure 71 while the other end 83 acts as a bearing for the axis 84 integral with the casing 80. The casing is connected at its lower portion by a pipe line 85 to a source of the coating material or composition equipped with a feed system under pressure of the casing (not shown).

It will be noted that the position of the casing is adjustable with respect to the structure by pivoting around the suspension axis 84 and that once the casing is placed in an appropriate position, it can be blocked in this position by any suitable locking system (not shown). As may be seen in FIG. 6, the injection spout 81 of the casing is situated as close as possible to the smoothing zone formed between the ends 77 of the blades. In the course of operation, the composition is injected directly into the angle or corner formed between each of the blades and the web 21 and the injection spout is immersed in the product. The possible excess of the product is evacuated from the injection zone by running off on the surface 86 of the casing facing the web 21, this surface being spaced progressively from the sheet.

The excess is then collected in the reservoir 87.

The optimal setting of the elements of the device will now be specified with reference to the schematic of FIG. 7.

In effect, as is seen above, the distance between the injector spout and the smoothing zone must be as small as possible.

This distance depends upon:

(a) the thickness of the injector spout; and (b) the curvature of the blades which is a function of the geometry used in each application.

With reference to FIG. 7:

"e" is the thickness of the injector spout;

"d" is the optimal distance between the injector spout and the edge of the free end of the blades; and "$\alpha$" is the apparent angle at the end of the blade.

Furthermore, it will be agreed that the greek letter $\epsilon$ represents the space necessary for the passage of the web without rubbing and for the return of the coating composition, as well as the possible interval between the blade and the injector.

Calculation and experiment show that the optimum position of the injector is defined by the equation:

$$(e+\epsilon)/(d)=\tan\alpha$$

or $$d=(e+\epsilon)\cot\alpha$$

$\epsilon$ is generally between 0 and 10 mm, the standard space usually accepted for the passage of a web on an industrial paper machine.

In practice, the distance "d" selected will be smaller than the length of the blade utilized.

Several actual examples will now be given:

(a) with an injector having a 5 mm thickness of the spout (e=5 mm), placed at 2 mm from the paper and at 1 mm from the blade ($\epsilon$=3 mm and a blade forming an angle $\alpha$ of 12.8 degrees (cot g $\alpha$=4.4), the optimum distance of the injector will be:

$$d=[5+(2+1)]\times 4.4=35.2 \text{ mm}$$

(b) If, in the same configuration, one desires to place the injector at 5 mm from the paper:

$$d=[5+(5+1)]\times 4.4=48.4 \text{ mm}$$

(c) If one uses an injector having a 10 mm thickness, placed at 10 mm from the paper:

$$d=[10+(10+1)]\times 4.4=92.4 \text{ mm}$$

Furthermore, it should be noted that the device according to the invention makes it possible to perform symmetrical coatings as shown in FIGS. 3–6, as well as unsymmetrical coatings as shown in FIGS. 8 and 9.

The dissymmetry of the deposit of the coatings or layers on the two sides of the sheet article may be desired:

(a) either to voluntarily obtain a coated paper with different characteristics on its two sides; or (b) on the contrary, to rectify existing characteristics of one of the sides so as to obtain a paper identical on its two sides.

Practical experience up to now indicates that with the device according to the invention, the dissymmetry can be obtained in at least two ways, as may be seen from FIGS. 8 and 9, namely:

(a) either by displacement of the axis of the blades, i.e., in offsetting the two pneumatic chambers simultaneously, in an horizontal plane (FIG. 8); or (b) by lowering one of the pneumatic chambers (FIG. 9).

In FIG. 8, the device according to the invention has been shown in solid lines in which, as shown in the preceeding figures, the blades 11 and 12 are symmetrical with respect to the sheet article S. By acting on the blade holders the axis of the blades can be displaced and brought into the dissymmetric position shown in dashed lines at L1 and L2; while in the case of symmetry, the blades form the same angle $\alpha$ with respect to the element S, in the case of dissymmetry, the blade L1 forms an angle $\alpha$ and the blade L2 an angle $\beta$ with the element S. $\beta$ is smaller than $\alpha$ and the blade L2 smooths more.

In FIG. 9, the blades 14 and 13 have been shown in solid lines in their symmetrical position (having the same angle $\alpha$) with respect to the sheet article S. By lowering the pneumatic tube vertically a distance "ab" from its initial position shown in dashed lines at C4 to the position shown in solid lines C'4, the consequent displacement of the blade 14 towards its position in dashed lines L4 is caused, the blade thus forming an angle $\beta$ smaller than $\alpha$ with the sheet article S.

These displacements of the pneumatic chambers cause an increase in the deposit of the coating on the side where the blade becomes more smoothing, i.e., the side of the blade L2 in FIG. 8 and the side of the blade L4 in FIG. 9.

These different positions of the pneumatic chambers have made it possible to create relatively significant dissymmetries (for example, deposit of a coating of 8 g/m$^2$ on one side and of 14 g/m$^2$ on the other side).

In the case where the pressure element is not a pneumatic chamber, but, for example, a counterblade (FIGS. 10–13), the same dissymmetries will be obviously obtained by displacing the positions of the support lines of the counterblades on the smoothing blades under the same conditions.

These adjustments may be carried out continuously in operation, without changing the composition of the coatings and without other modifications of the device.

There are obviously, other means of creating such disymmetries, such as, for example:

(a) the selection of a thicker blade which is, therefore, more rigid, on one side (in this case, the deposit decreases with respect to the deposit obtained when a flexible blade is used; and (b) the modification of the coating composition to be applied on one of the two sides.

However, it appears that these two latter means are difficult to carry out in a continuous coating process.

FIGS. 10–13 represent an advantageous means making it possible to exert a pressure on the smoothing blade, at the contact zone between the smoothing blade and the paper. In these embodiments, the pressure element comprises an elastic counterblade situated outside the smoothing blade, and whose free end is elastically maintained applied on the smoothing blade at the point of contact between the said smoothing blade and the sheet article. The opposite end is fixed in a moveable holder such that, when placed under pressure, the counterblade has a curvature whose convexity is turned towards the sheet article. This counterblade can be made out of any appropriate flexible material such as metal, plastic, etc.

The counterblade can be placed either in the same direction as the corresponding smoothing blade or in the opposite direction. The respective fixing points of the smoothing blade and of the counterblade are, in this latter case, situated on both sides of the contact zone between these two elements.

To make clear the following description this will be limited to embodiments in which the smoothing blade and the counterblade are placed in the same direction.

As may be seen from FIG. 10, a web of paper 1 moves upwards in the direction of the arrow, through an appropriate machine. Two smoothing blades 75 and 75' maintained by holders 73 and 73' exert, on the two sides of the paper web, at a point 81, a pressure for smoothing a layer of a coating composition on each of the two sides of the paper. The coating composition is supplied between the paper web and the blade 75 by means of an apparatus, not shown, such as those described in the preceeding examples. The planarity of the free end of the blades 75 and 75' (smoothing zone) is ensured by means of counterblades 83 and 83'. Preferably, the blades 83 and 83' are shorter than the blades 75 and 75' which are advantageously very flexible which further assures a more uniform smoothing effect over the width of the sheet.

Each counterblade 83 is fixed in a support 84. Thanks to conventional simple means not shown, the holders 84 can be rotated and displaced vertically (y'—y) and horizontally (x'—x). It is thus possible to adjust the pressure force by modifying the curvature of the counterblade, while setting the free first end of the counterblade adjacent to the free first end or edge of the smoothing blade.

In FIG. 11 the device comprises the same elements as in FIG. 10 as well as auxiliary means in form of pneumatic tubes 78 and 78' which can be placed at any appropriate point on the counterblade, towards the middle, or towards the free end. One can thus further adjust the pressure of fluid into the pneumatic tube and the position of this tube on the counterblade.

The device of FIGS. 12 and 13 comprises all the elements of the device of FIG. 10 as well as a pressure system consisting of a series of finger segments 85, arranged along the width of the sheet. These finger segments can be set so as to act on the counterblade at any point situated between the free end of the counterblade and its fixing point. According to the invention, these fingers are adjustable. They can be adjusted one by one or together, manually or automatically, and may, for example, be controlled by a device connected to a sensor which detects irregularities in the coating along the width of the sheet so as to modify the pressure exerted by one or more fingers and as a function of the correction to be made for the defects detected at the level of said fingers.

The pressure exerted along the width of the smoothing blade can thus be immediately regulated as a function of particular coating conditions (irregularities of the base web or of the deposit of the coating extending along the width of the web, for example). One can likewise compensate for an accidental located deformation of the smoothing blade without having to immediately change the damaged blade.

The fingers can be mounted on a support 86, which can comprise all of the elements necessary for an automatic or manual control.

The embodiments of the pressure element described hereabove (FIGS. 10–13) are particularly adapted for obtaining a good straightness and a great reliability of the support line on the smoothing blades. They also allow for, on an industrial scale, simple and precise adjustment of the support line, this support line being well defined and easy to visualize.

They can be set instead of the pneumatic tubes in all the examples described above (FIGS. 1–9) in case of a one side coating as well as both sides coating of a web.

The invention having been described and its interest proved by way of detailed examples, the applicant reserves for himself the sole rights thereof as long as the Patent will be in force, without any other limitation than that expressly set forth in the appended claims.

We claim:

1. A process for continuously coating a sheet article comprising:

(a) continuously moving said sheet article in a predetermined direction;

(b) placing a coating composition into contact with at least one surface of said sheet article;

(c) exerting pressure on said at least one surface to ensure spreading of said coating composition; and (d) conducting said sheet article between at least two elements, at least one of said elements comprising a spreading blade subjected to a force applied substantially at a zone of contact between said blade and said sheet article, said blade being spaced apart from said sheet article other than at said contact zone, said force being different from the flexion force of said blade, wherein said coating composition is placed into contact with said sheet article by directing a continuous stream of said coating composition under pressure out of an injector directed towards said zone of contact whereby said stream directly contacts said sheet article substantially at the zone of contact.

2. A process in accordance with claim 1 wherein said sheet article is conducted between said elements in a substantially upward vertical direction and wherein said coating composition is injected in a substantially upward vertical direction toward said zone of contact whereby excess coating composition is evacuated by gravity.

3. A process in accordance with claim 1 wherein said composition is injected by an injector having an outlet orifice positioned immediately adjacent to said contact zone and upstream of said contact zone as viewed with respect to the direction of movement of said sheet article.

4. A process in accordance with claim 3 wherein said blade has a free end which is in contact with said sheet article, said process further comprising positioning said injector outlet at a distance from said free blade end which is equal to the width of the injector plus the sum of the clearances between said injector and said sheet article, and said injector and said spreading blade multiplied by the cotangent of the angle formed by said spreading blade and said sheet article.

5. A process in accordance with claim 1 wherein said blade has a free end which contacts said sheet article and is substantially parallel to the direction of movement of said article, and wherein said coating composition is injected in a direction generally parallel to said direction of movement and said blade end.

6. A process in accordance with claim 1 wherein each of said elements comprises a spreading blade, said spreading blades being symmetrically positioned about the sides of said sheet article.

* * * * *

UNITED STATES PATENT AND TRADEMARK OFFICE

CERTIFICATE OF CORRECTION

PATENT NO. : 4,331,713

DATED : May 25, 1982

INVENTOR(S) : Pierre GIRARD et al.

It is certified that error appears in the above-identified patent and that said Letters Patent is hereby corrected as shown below:

Abstract, line 2, delete "of".

Abstract, line 5, "an" should be --a--.

Abstract, line 10, "planer" should be --planar--.

Abstract, line 14, "among others" should be --for example--.

Column 1, line 25, "applicant" should be --Applicant--.

Column 1, line 54, after "breaking" insert --,--.

Column 3, line 66, "blades" should be --blade--.

Column 4, line 23, delete "to".

Column 6, line 16, "An" should be --A--.

Column 10, line 15, after "used" insert --)--.

Column 10, line 52, "preceeding" should be --preceding--.

Column 11, line 43, "applicant" should be --Applicant--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*